United States Patent [19]

Shepard

[11] 4,183,488

[45] Jan. 15, 1980

[54] BRACKETS FOR CONSTRUCTING TEMPORARY OR MOVEABLE SHELVING

[76] Inventor: John S. Shepard, 1304 S. Shields St., Ft. Collins, Colo. 80521

[21] Appl. No.: 913,202

[22] Filed: Jun. 6, 1978

[51] Int. Cl.[2] ..... A47G 29/02; A47B 3/00

[52] U.S. Cl. ..... 248/247; 108/111; 248/250

[58] Field of Search ..... 108/101, 111; 211/186, 211/188; 248/235, 247, 248, 250; 312/111

[56] References Cited

U.S. PATENT DOCUMENTS

| | | | |
|---|---|---|---|
| 617,164 | 1/1899 | Jewett | 248/248 |
| 753,678 | 3/1904 | Dannenberg | 108/111 |

FOREIGN PATENT DOCUMENTS

| | | | |
|---|---|---|---|
| 629629 | 3/1963 | Belgium | 108/111 |

*Primary Examiner*—James C. Mitchell

*Attorney, Agent, or Firm*—Hugh H. Drake

[57] ABSTRACT

A shelf bracket for constructing temporary or moveable shelving from spaced elongated shelf boards. Each bracket is formed by an elongated vertically extending leg having a U-shaped clip portion at each end of said leg for engaging a marginal edge of a shelf board. Each U-shaped clip portion includes a pair of spaced clip arms adapted for snug engagement with the shelf board. The outermost clip arm of each U-shaped clip portion is coextensive with and extends laterally from an end edge of said leg. The bracket is provided with apertures in the leg adjacent each U-shaped clip portion for receiving fasteners engageable with the marginal edges of the shelf boards.

3 Claims, 3 Drawing Figures

BRACKETS FOR CONSTRUCTING TEMPORARY OR MOVEABLE SHELVING

FIELD OF THE INVENTION

The present invention relates to shelf brackets and more particularly to brackets for constructing temporary or moveable shelving such as bookcases from elongated boards or shelving.

BACKGROUND OF THE INVENTION

A wide variety of shelf brackets and supporting structures are known in the art. See for example, U.S. Pat. No. 1,586,213 issued May 25, 1926 to L. A. Nielsen for "Display Stand"; U.S. Pat. No. 2,628,141 issued Feb. 10, 1953 to C. Scheuer for "Adjustable Shelf Mounting"; and U.S. Pat. No. 2,848,119 issued Aug. 19, 1958 to R. J. Fitser for "Display Stand."

OBJECTS AND SUMMARY OF THE INVENTION

It is the principal object of the present invention to provide an improved shelf bracket for supporting elongated boards or lumber in spaced vertical alignment for purposes of forming bookshelves and the like.

A more specific object of the present invention is to provide a shelf bracket which is simple, lightweight and can readily be assembled with a piece of board or lumber to form shelving in any desired vertical configuration.

A further object of the present invention is to provide a shelf bracket of the foregoing character which is universal in application so that it can be used as both a front and rear bracket and in which the top and bottom ends are reversible.

A further object of the present invention is to provide a bracket of the foregoing character which can be securely assembled with appropriate lengths of board or lumber and yet is susceptible of being readily dismounted when it is desired to disassemble and move the shelves thus formed.

Other objects and advantages of the present invention will become apparent as the following description proceeds.

In accordance with the foregoing objects, the present invention is embodied in a bracket formed by an elongated, vertically extending, narrow rectangular leg or back having a U-shaped clip portion at each end thereof for engagement with the marginal edge of a shelf board. Each U-shaped clip portion includes a pair of spaced, parallel, clip arms extending laterally from the leg and spaced for snug engagement with the marginal edge of a shelf board. The outermost clip arm of each U-shaped clip portion is coextensive with and extends laterally from an end edge of said leg so as to provide either a top or a foot, depending upon the vertical orientation of the leg. For securing the bracket to a board, an aperture is provided at each end of the leg adjacent the U-shaped clip portion and opening through the leg into the web between the spaced clip arms. An appropriate fastener can be inserted through the bracket into engagement with the marginal edge of a shelf board. For mounting the bracket on a wall or vertical board, an additional aperture may be provided generally centrally of the leg.

The brackets are mounted in pairs, one on each side of a shelf board, four brackets being utilized with a pair of spaced boards to provide a shelf structure. A variety of shelf boards can be aligned and supported one above the other by utilizing a plurality of pairs of the shelf brackets. The brackets may be made in a variety of lengths to provide for selective spacing between the shelf boards.

DESCRIPTION OF THE PREFERRED EMBODIMENT

Figure 1:
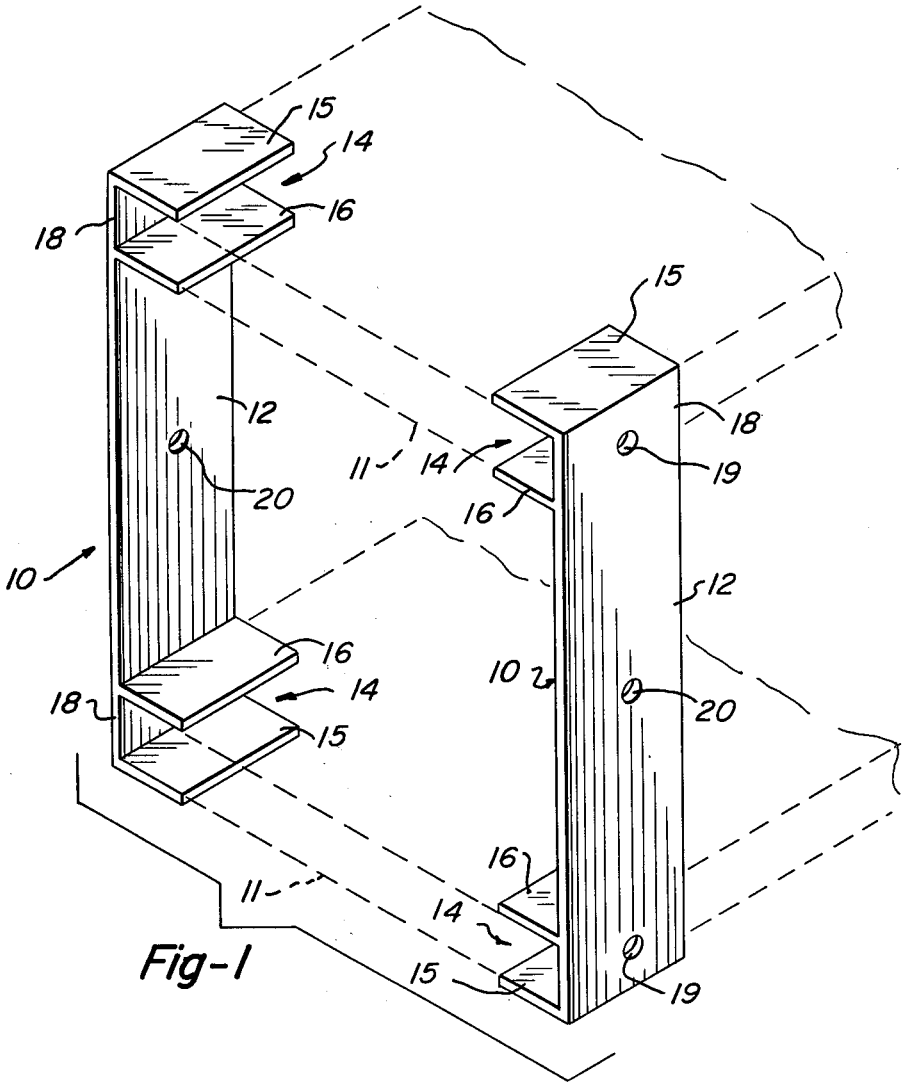
FIG. 1 is a perspective view of a pair of shelf brackets embodying the present invention in position for alignment with and supporting of juxtaposed shelving.
Figure 2:
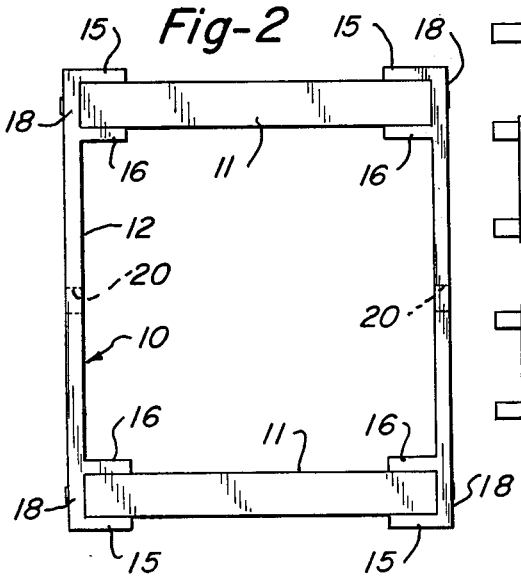
FIG. 2 is an end view of a pair of shelf boards held in vertically disposed spaced-apart relationship by a pair of shelf brackets embodying the present invention.

Shelf brackets embodying the present invention are shown generally at 10 in FIG. 1 in position for receiving a pair of vertically spaced shelf boards 11. When a plurality of such brackets and boards are aligned vertically, one above the other, a wide variety of shelf arrangements can be constructed, one illustrative such arrangement being shown in FIG. 3. While the brackets may be made of various lengths, it is desirable to utilize a bracket length sufficient to accommodate standard sizes of books. It should be understood, however, that the shelving is not limited to bookshelving, but may be utilized to support stereo equipment, knickknacks, flower pots and the like.

The shelf brackets as shown in FIG. 1 each include an elongated rectangular leg or back 12 of a length providing the desired shelf spacing. For engaging the marginal edge of a shelf board 11, a U-shaped clip portion 14 is provided at each end of the leg. Each U-shaped clip portion 14 is defined by an outer laterally extending clip arm 15 and an inner laterally extending clip arm 16 extending parallel to and in spaced relation with respect to the outer clip arm 15 for purposes of providing the U-shaped clip portion 14 for snug engagement with a marginal edge of the shelving board. Means are provided for securing the brackets to the shelving. For this purpose, the portion of the leg 12 between the clip arms defines a clip web portion 18 through which there is provided an aperture 19 for insertion of a fastener such as a nail or screw through the bracket leg into the marginal edge of the shelf board 11.

For supporting the shelf assembly on a floor, table or other surface, the outer clip arm 15 on each end of the leg 12 further defines a foot or platform. This foot, when located at the very bottom of the shelf structure, supports the shelf assembly. To provide a stable shelf structure, the brackets are utilized in opposing pairs. For some applications in which it is desired to secure the shelf structure to a wall, an aperture 20 may be provided in the central portion of the leg 12 for receiving an appropriate fastener.

Figure 3:
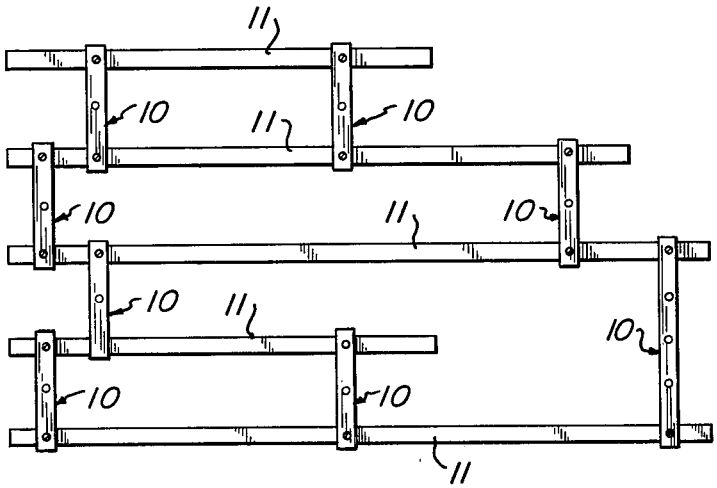
FIG. 3 is a side elevation view of one arrangement of shelving utilizing shelf brackets embodying the present invention.

The brackets may be made of a variety of lengths as shown in FIG. 3 so as to provide the desired spacing between the shelf boards 11. With the bracket embodying the present invention, a large variety of imaginative shelf structures can be constructed utilizing brackets of selected lengths and appropriate lengths of shelf boards. It will be understood that the U-shaped clip portion 14 of the brackets 10 is dimensioned to fit standard lumber. For example, when one inch board is being used, which has a standard thickness of approximately three-fourths of an inch, the spacing between the upper and lower clip arms will be approximately three quarters of an inch.

The brackets are formed of any suitable material such as an extrudable plastic, aluminum and the like. The edges and corners of the bracket are rounded making the bracket not only useful but aesthetically pleasing when embodied in a shelf structure.

While a certain embodiment of the present invention has been shown and described in detail, it should be understood that there is no intention to limit the invention to the specific form disclosed. On the contrary, the intention is to cover all modifications, alternative constructions, equivalents and uses falling within the spirit and scope of the invention as expressed in the appended claims.

I claim as my invention:

1. A one-piece shelf bracket for constructing temporary or moveable shelving from spaced elongated shelf boards of standard thickness, comprising:

an elongated vertically extending leg;

a U-shaped clip portion integrally projecting laterally from each end of said leg;

each U-shaped clip portion including a pair of spaced clip arms adapted for snug engagement with the marginal edge portion of a shelf board;

the outermost clip arm of each U-shaped clip portion being coextensive with and extending laterally from an end edge of said leg;

and means defining a fastener receiving aperture in said leg adjacent to each U-shaped clip portion and opening between said clip arms for receiving a fastener for securing said bracket to the marginal edge portion of a shelf board.

2. A shelf comprising a pair of horizontally extending spaced parallel shelf boards of standard thickness, two spaced apart pairs of one-piece shelf brackets engaged with the marginal edge portions of said boards for holding the same in spaced parallel relationship, each of said shelf brackets comprising an elongated vertically extending leg, a U-shaped clip portion integrally projecting laterally from each end of said leg, each U-shaped clip portion including a pair of spaced clip arms snuggly engaging the marginal edge portion of a shelf board, the outermost clip arm of each U-shaped clip portion being coextensive with and extending laterally from an end edge of said leg, means defining a fastener receiving aperture in said leg adjacent to each U-shaped clip portion and opening between said clip arms, and fastener means extending through said aperture and securing said leg to the marginal edge of the board engaged by said bracket, whereby a rigid rectangular shelf structure is formed by said brackets and shelf boards.

3. A one-piece shelf bracket, for constructing temporary or moveable shelving from spaced elongated shelf boards of standard thickness, comprising:

an elongated vertically extending leg;

a U-shaped clip portion integrally projecting laterally from each end portion of said leg;

each U-shaped clip portion including a pair of spaced clip arms integrally projecting from the same side of the respective end portion of said leg to define means for snug engagement with the marginal edge portion of a shelf board;

and means defined in association with each U-shaped clip portion for enabling securement of said bracket to the marginal edge portion of a shelf board.

* * * * *